United States Patent [19]

Stanish, Jr.

[11] Patent Number: 4,991,823

[45] Date of Patent: Feb. 12, 1991

[54] PICKET FENCE CAP

[76] Inventor: William A. Stanish, Jr., 6004 38th Ave. East, Bradenton, Fla. 34208

[21] Appl. No.: 515,089

[22] Filed: Apr. 26, 1989

[51] Int. Cl.[5] ..... E04H 17/00

[52] U.S. Cl. ..... 256/1; 256/65; 285/901; 52/301

[58] Field of Search ..... 256/59, 65; 285/901; 52/301; 405/255; 138/89

[56] References Cited

U.S. PATENT DOCUMENTS

| | | | |
|---|---|---|---|
| 3,349,538 | 10/1967 | Crossman | 52/301 X |
| 3,368,798 | 2/1968 | Kusel et al. | 256/65 |
| 4,050,828 | 9/1977 | Noro | 256/65 X |
| 4,623,756 | 11/1986 | Wilson, Jr. | 52/301 X |

FOREIGN PATENT DOCUMENTS

| | | | |
|---|---|---|---|
| 690391 | 7/1964 | Canada | 52/301 |

*Primary Examiner*—Andrew V. Kundrat
*Attorney, Agent, or Firm*—Charles J. Prescott

[57] ABSTRACT

A picket fence cap has a top which is coextensive with the top of a square cross-sectioned, fence member which may be a hollow picket or post. The fence member has at least one internal, longitudinally extending fastener receiver channel centrally located on one wall. The picket fence cap has a depending bottom which is inserted into the open end of the fence member. The depending bottom includes a leg which is press fitted into the channel. In one embodiment, for a fence member with opposed channels, the depending leg extends laterally to fit in both channels. In another embodiment, for a fence member which has one channel the depending bottom has a Y-shaped cross-section with a channel fitting leg and a pair of legs which extend to opposite corners.

5 Claims, 1 Drawing Sheet

PICKET FENCE CAP

BACKGROUND OF THE INVENTION

1. Field of the Invention

This invention relates generally to picket fences formed of hollow metal members, and more particulary for a cap for use with such members.

2. Description of Related Art

Picket fences which have been built with wood for many years are now fabricated of extruded aluminum. Both the vertical pickets and the posts, to which the pickets are connected by horizontal stringers, are hollow and have opposed longitudinally extending internal channels for receiving fasteners as needed. Flat caps are available for use to close the open ends of these hollow members; however, portions of the parts of these caps which are inserted into the hollow ends must be cut away to accommodate the channels—a time consuming operation. These caps also are easily removed.

U.S. Pat. No. 3,368,798, Kusel et al., entitled: "Railing Assembly Having a Replaceable Newel Post Cap", discloses a cap for use with hollow newel posts having a square cross-section without internal channels. The portion of this cap to be inserted in the end of the newel post has an X-shaped cross-section.

I am not aware of any cap having a portion designed to be press fitted into one or both of the internal channels so as to be securely fastened thereto, and not requiring any additional cutting or forming.

SUMMARY OF THE INVENTION

A picket fence cap is formed to have a dependent portion which can be press fitted into one or both internal channels of pickets and posts. The upper portion of the cap may be substantially flat or have a decorative configuration. The cap is preferably formed by molding of a material such as nylon or plastic which may deform slightly went pressed into place in the picket or post channel. In one embodiment, the dependent part of the cap is a laterally extending leg which will fit into opposed internal channels. In another embodiment, the dependent part has a Y-shaped cross-section with the base leg designed to fit into an internal channel, and the two angular legs extending to corners of the hollow member.

It is therefore an object of this invention to provide a cap for hollow pickets and posts having longitudinally extending internal fastener receiving channels therein.

It is a further object of this invention to provide such a cap which will include a depending portion which can be pressed into at least one such internal channel.

In accordance with these and other objects, which will become apparent hereafter, the instant invention will now be described with reference to the accompanying drawings.

DETAILED DESCRIPTION OF THE INVENTION

Figure 5:
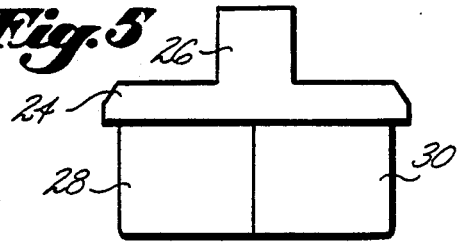
FIG. 5 is an elevation view of a second embodiment of a picket fence cap in accordance with the invention.
Figure 1:
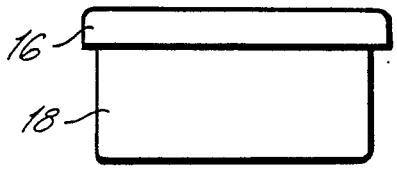
FIG. 1 is an elevation view of a first embodiment of a picket fence cap in accordance with the invention.
Figure 6:
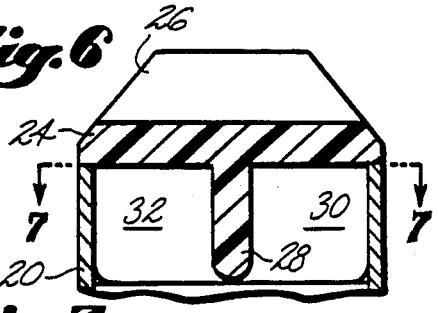
FIG. 6 is a cross-sectional view taken on the line 6—6 of FIG. 7 of the second embodiment of the invention in position on a fence member.
Figure 2:
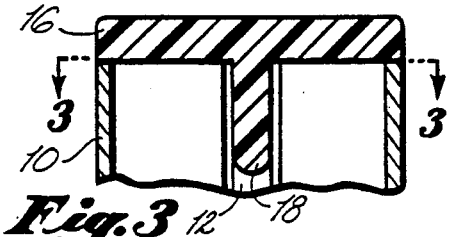
FIG. 2 is a cross-sectional view taken on the line 2—2 of FIG. 3 of the first embodiment of the invention in position on a fence member.

Referring first to FIGS. 1 through 4, a fence member 10, which may be a picket or a post, is shown to have internal, longitudinally extending fastener recess channels 12 and 14. Such channels are made to receive fasteners inserted from the ends or through the side walls in the assembly of a fence in which a plurality of vertical pickets are secured to vertical posts by horizontally extending stringers.

Instead of leaving the ends of such fence members open, it is conventional to cap them with a plain flat or decorative cap. The caps currently available have a square cap portion with a square depending sleeve portion which is to be inserted in the end of the fence member. Because of the interfering channel members 12 and 14, it is necessary to cut away portions of the sleeve before the sleeve can be pushed into the opening. This is time consuming and also diminishes the structural integrity of the sleeve so that the cap is relatively easy to remove.

In accordance with the invention, the cap has a top 16 which typically is coextensive with the top of the fence member so as to completely cover it. Depending from top 16 is laterally extending leg 18. Leg 18 is sized to extend completely into channels 12 and 14 and has a thickness which is no less than the width of the openings of channels 12 and 14 and may preferably be slightly larger so that it must be pressed into position rather than fall into place. This insures that the cap will not easily be removed and also permits its use on the bottom openings of fence members where appropriate. The cap is preferably fabricated of a material which can be slightly deformed such as nylon or plastic.

Figure 7:
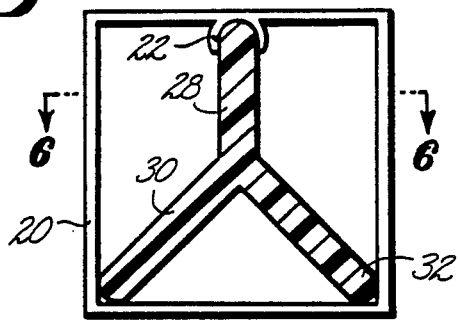
FIG. 7 is a cross-sectional taken on the line 7—7 of FIG. 6.
Figure 3:
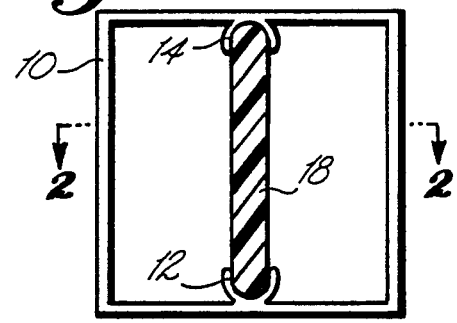
FIG. 3 is a cross-sectional view taken on the line 3—3 of FIG. 2.
Figure 8:
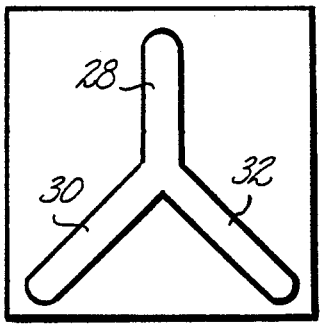
FIG. 8 is an elevation view of the second embodiment of the picket fence cap.
Figure 4:
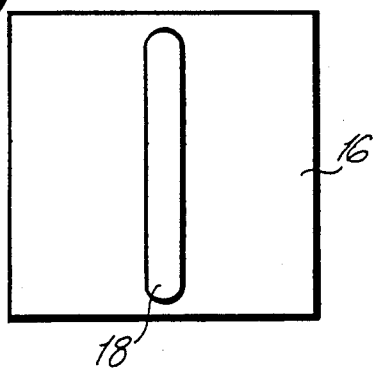
FIG. 4 is an elevation view of the first embodiment of the picket fence cap.

Turning next to FIGS. 5 through 8, fence member 20, which may be a picket or post, is shown to have a single internal, longitudinally extending fastener recess channel 22. The picket fence cap has a top 24 which includes an upwardly extending decorative portion 26. Depending from top 24 is a Y-shaped bottom having channel leg 28 and corner legs 30 and 32. Since corner legs 30 and 32 extend into the corners of fence member 20, as shown in FIG. 7, they aid in maintaining channel leg 28 in position.

Although it may not be evident from the drawing, the channels have a truncated circular cross-section with an opening width which is less than the internal diameter. The leg of the cap when pressed into position will preferably have a thickness slightly greater than the opening width so that the channel opening edges "bite" into the leg.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

I claim:

1. A picket fence cap for a hollow picket or post fence member having a square cross-section having four internal corners, an open end and at least one internal longitudinally extending fastener receiving channel centrally positioned on one wall therein opposite two internal corners comprising:

a top coextensive with the fence member end;

a bottom portion depending from said top;

said bottom portion having a laterally extending leg having an end positioned to be pressed into the fence member channel when said top is aligned with the fence member and;

a pair of angularly extending legs are joined to said laterally extending leg;

said pair of angularly extending legs having ends positioned to be in the corners opposite the one fence member channel.

2. A picket fence cap in accordance with claim 1 wherein:

the fence member channel has an opening width and said leg is at least as thick as the opening width.

3. A picket fence cap in accordance with claim 2 wherein:

said leg is thicker than the opening width.

4. A picket fence cap in accordance with claim 1 wherein:

said picket fence cap is fabricated of nylon.

5. A picket fence cap in accordance with claim 1 wherein: said picket fence cap is fabricated of plastic.

* * * * *

UNITED STATES PATENT AND TRADEMARK OFFICE

CERTIFICATE OF CORRECTION

PATENT NO. : 4,991,823

DATED : February 12, 1991

INVENTOR(S) : William A. Stanish, Jr.

It is certified that error appears in the above-identified patent and that said Letters Patent is hereby corrected as shown below:

Column 3, line 15, rewrite "and" as -- end --.

Signed and Sealed this

Second Day of June, 1992

*Attest:*

DOUGLAS B. COMER

*Attesting Officer*

*Acting Commissioner of Patents and Trademarks*